US006224495B1

(12) United States Patent
Teramoto

(10) Patent No.: US 6,224,495 B1
(45) Date of Patent: May 1, 2001

(54) GOLF CLUBS AND GOLF CLUB SETS

(75) Inventor: Seiichiro Teramoto, Gyoubashi (JP)

(73) Assignee: Aneeging Sports Co., Ltd. (JP)

( * ) Notice: Subject to any disclaimer, the term of this patent is extended or adjusted under 35 U.S.C. 154(b) by 0 days.

(21) Appl. No.: 09/239,576

(22) Filed: Jan. 29, 1999

(51) Int. Cl.[7] ..... A63B 53/00
(52) U.S. Cl. ..... 473/287; 473/290
(58) Field of Search ..... 473/289, 287, 473/290

(56) References Cited

U.S. PATENT DOCUMENTS 5,192,073 * 3/1993 Iwanaga et al. .
5,228,688 * 7/1993 Davis ..... 473/290
5,924,936 * 7/1999 Penley ..... 473/289

FOREIGN PATENT DOCUMENTS

2227418 * 1/1990 (GB) .

* cited by examiner

*Primary Examiner*—Jeanette Chapman
*Assistant Examiner*—Stephen L. Blau
(74) *Attorney, Agent, or Firm*—Baker & Daniels

(57) ABSTRACT

A golf club set in which the weight balance of club shafts is optimized for each individual club. The weight balance at the grip-end of the shaft of each of the individual golf clubs increases as the corresponding loft angles of each of the individual golf clubs increase.

2 Claims, 6 Drawing Sheets

| LOFT ANGLE (° ) | WEIGHT (g) | |
|---|---|---|
| | Region A | Region B |
| 10 | 25 | 44 |
| 15 | 26 | 43 |
| 20 | 27 | 42 |
| 25 | 28 | 41 |
| 30 | 29 | 40 |
| 35 | 30 | 39 |
| 40 | 31 | 38 |
| 45 | 32 | 37 |
| 50 | 33 | 36 |
| 55 | 34 | 36 |

| LOFT ANGLE (° ) | Diameter at A (mm) |
|---|---|
| 10 | 8.4 |
| 15 | 8.5 |
| 20 | 8.6 |
| 25 | 8.7 |
| 30 | 8.8 |
| 35 | 8.9 |
| 40 | 9.0 |
| 45 | 9.1 |
| 50 | 9.2 |
| 55 | 9.3 |

Fig. 3

| LOFT ANGLE (°) | WEIGHT (g) | |
|---|---|---|
| | Region A | Region B |
| 10 | 25 | 44 |
| 15 | 26 | 43 |
| 20 | 27 | 42 |
| 25 | 28 | 41 |
| 30 | 29 | 40 |
| 35 | 30 | 39 |
| 40 | 31 | 38 |
| 45 | 32 | 37 |
| 50 | 33 | 36 |
| 55 | 34 | 36 |

Fig. 6

| LOFT ANGLE (°) | Diameter at A (mm) |
|---|---|
| 10 | 8.4 |
| 15 | 8.5 |
| 20 | 8.6 |
| 25 | 8.7 |
| 30 | 8.8 |
| 35 | 8.9 |
| 40 | 9.0 |
| 45 | 9.1 |
| 50 | 9.2 |
| 55 | 9.3 |

GOLF CLUBS AND GOLF CLUB SETS

TECHNICAL FIELD

The present invention relates to golf clubs and golf club sets, and more particularly to golf club sets in which the weight balance of shafts is optimized for each individual club.

BACKGROUND ART

In recent years, golf clubs have been improved remarkably. In many cases, club heads have been designed in order to broaden their sweet spots or to lower their centers of gravity. For the shafts of golf clubs, new materials are being used to control flexibility or strength against twist.

DISCLOSURE OF THE INVENTION

According to other features, characteristics, embodiments and alternatives of the present invention which will become apparent as the description thereof proceeds below, the present invention provides golf club sets in which weight balance of the club shafts is optimized for each individual club.

According to another embodiment of the present invention, golf clubs are designed so as to produce optimized or improved perform characteristics for each individual club for golfers of all levels of experience, from beginners or novice to professional golfers.

The present invention is applicable to both woods and irons.

According to a first aspect of the invention, in golf club sets, the weight balance at the grip-end of the shaft of each of the individual golf clubs increases as the corresponding loft angle of each of the individual golf clubs increases.

According to a second aspect of the invention, golf clubs are characterized by controlling the weight balance of the shafts so that the weight at the grip-end increases as the loft angles increase.

Additional objects, advantages and novel features of the invention will be set forth in the description that follows, and will otherwise become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF DRAWINGS

The present invention will be described hereafter with reference to the attached drawings which are given as non-limiting examples only, in which:

FIG. 3 is a table showing examples of weight balances between the regions A and B for each club in a set according to one embodiment of the present invention.

FIG. 6 is a table showing examples of diameters at a point A of shafts according one embodiment of the present invention.

BEST MODE FOR CARRYING OUT THE INVENTION

The present invention is directed to golf clubs and golf club sets, and more particularly to golf club sets in which the weight balance of shafts is optimized for each individual club. In golf club sets, each individual club is required to have separate characteristics. That is, it is required, for long (less-lofted) clubs, such as drivers, to effect a long driving distance. On the other hand, shorter (more-lofted) clubs, such as pitching wedges, are required to have accuracy both in direction and distance.

Figure 1:
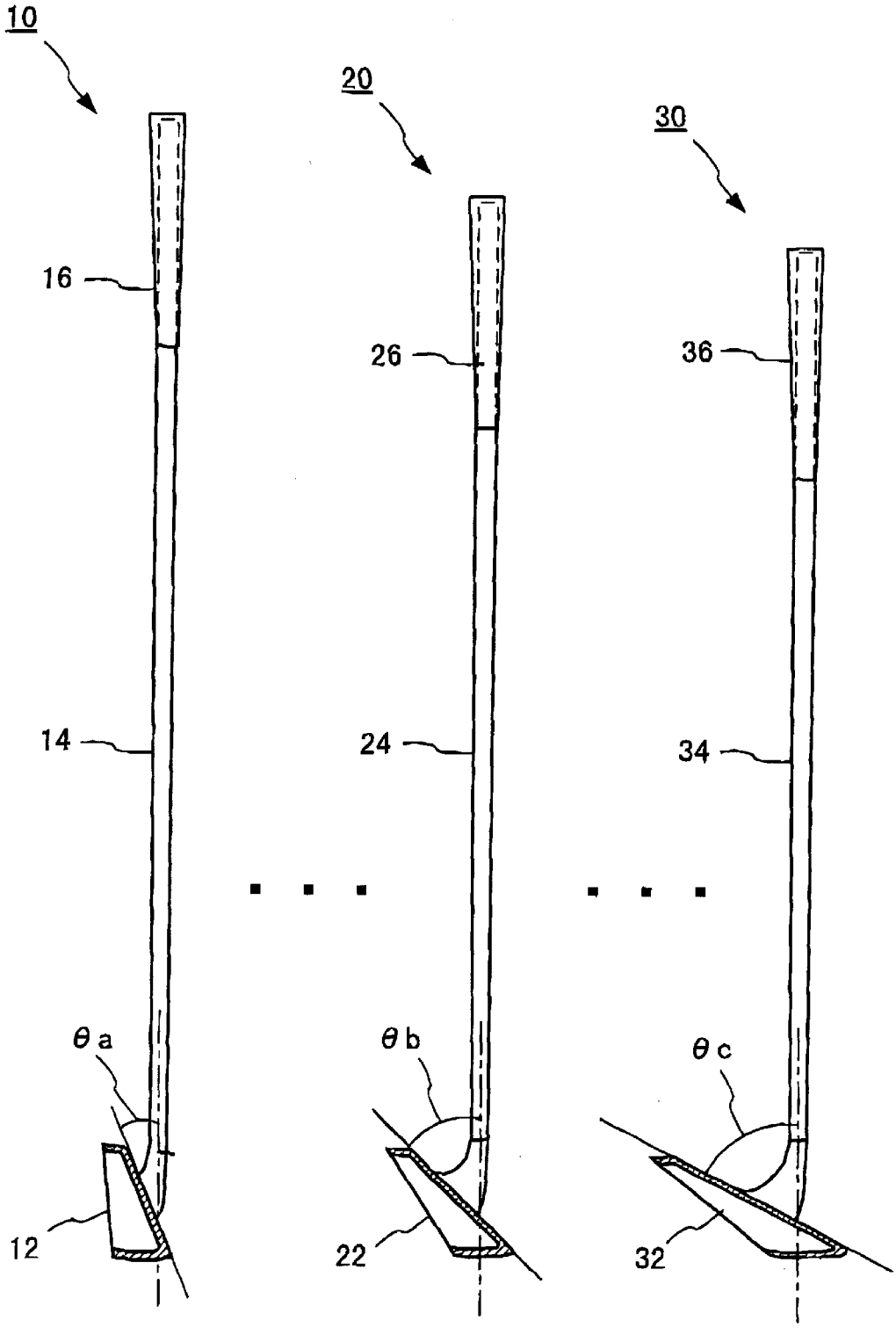
FIG. 1 is a plan view illustrating an iron set designed according to one embodiment of the present invention.

FIG. 1 shows a golf club set to which the present invention is applied. The golf club set includes a long iron 10 having a small loft angle of θa, a middle iron 20 having a medium loft angle of θb and a short iron 30 having a large loft angle of θc. The golf club set may include other clubs having different loft angles. In FIG. 1, the loft angles are defined by measuring the angle formed by the central line of a shaft and the face of a club head.

In FIG. 1, the long iron 10 includes a head 12 having a face with a loft angle θa, a grip 16 which a player grasps, and a shaft 14 which connects the head 12 and the grip 16. In the same manner, the middle iron 20 includes a head 22 having a face with a loft angle θb, a grip 26 which a player grasps, and a shaft 24 which connects the head 22 and the grip 26. The short iron 30 includes a head 32 having a face with a loft angle θc, a grip 36 which a player grasps, and a shaft 34 which connects the head 32 and the grip 36. As discussed below, the present invention optimizes the weight balance of shafts of golf clubs.

Figure 2:
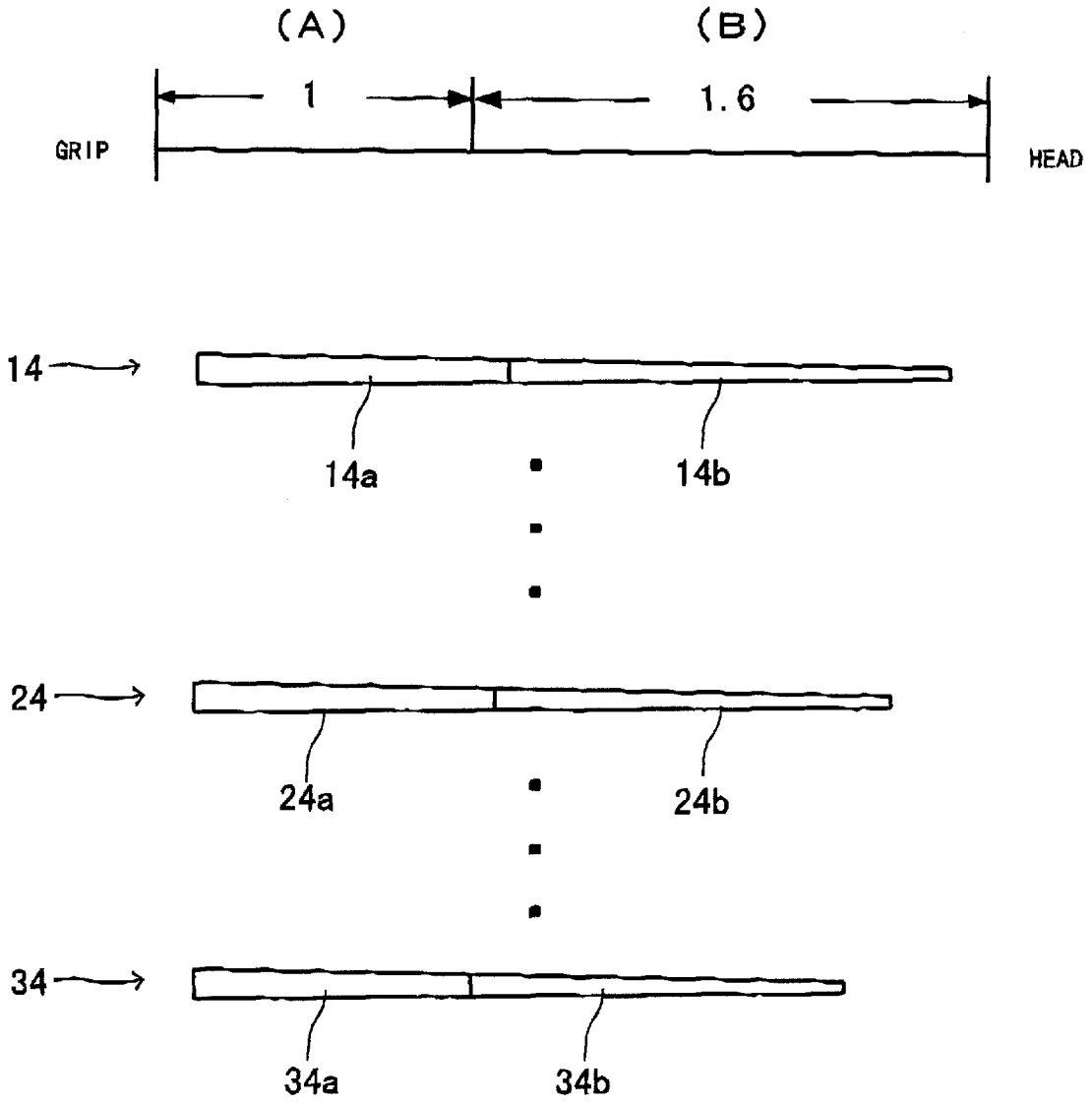
FIG. 2 is a diagram showing shafts of golf clubs each of which is divided two regions (A and B) which reference the manner in which the weight balance is regulated according to one embodiment of the present invention.

FIG. 2 shows shafts of golf clubs each of which is divided two regions (A and B) so as to regulate or reference how the weight balance is achieved according to one embodiment of the present invention. As shown in FIG. 2, regions A and B are divided so as to have length ratios of about 1 to 1.6 from the grip-end of the shaft. In FIG. 2, the regions A and B are indicated by 14*a* and 14*b* for a shaft 14 of the long club 10. For a shaft 24 of the middle club 20, the regions A and B are indicated by 24*a* and 24*b*. For a shaft 34 of the short club 30, the regions A and B are indicated by 34*a* and 34*b*.

FIG. 3 is a table showing an example of the weight balance (distribution) between the regions A and B of the shaft of each club. As shown in the table, for the clubs with smaller loft angles, the weight of the region A is set to be lighter and the weight of the region B is set to be heavier as compared to the clubs with larger loft angles. This weight balance relationship causes the clubs to feel heavier at the head-end of the club as compared to the grip-end during a swing. Because the mass is increased near the club head, more power can be transferred to the ball at the moment of impact. Therefore, according to the present invention, less-lofted clubs can effect longer driving distances.

For clubs with larger loft angles, the weight of the region A is set to be heavier and the weight of the region B is set to be lighter as compared to the clubs with smaller loft angles. This weight balance relationship causes the clubs to feel heavier at the grip-end of the club as compared to the head-end during a swing. Because the pivot point of a swing tends to be more stabilized with the weight balance of the present invention, it is possible to obtain a more solid impact.

Figure 4:
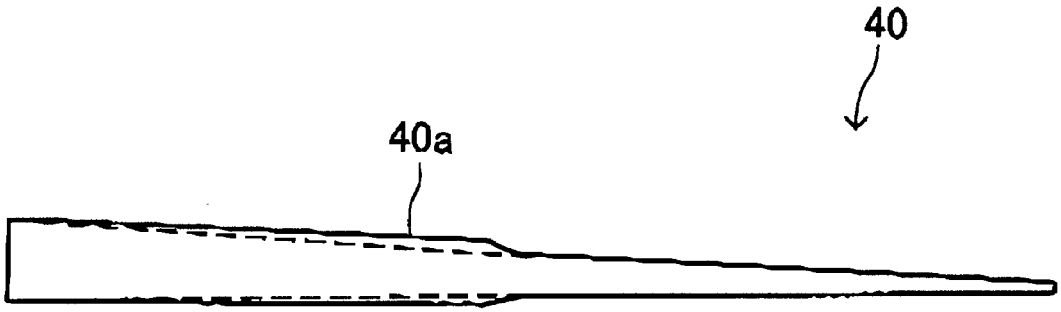
FIG. 4 is a plan view illustrating the core of a shaft of a golf club with a large loft angle, according to another embodiment of the present invention.

FIG. 4 shows a core 40 of the shaft of a short club, according to another embodiment of the present invention.

Typically the cores of golf club shafts for a given set of clubs are designed to have a larger diameter at the grip-end and a smaller diameter at the head-end. The shaft cores for longer clubs are designed to be longer than those for shorter clubs. The diameter of the core at the grip-end is designed to be similar within a given set of clubs. In the same manner, the diameter of the core at the head-end is designed to be similar within a given set of clubs. In other words, the shaft cores of longer clubs are shaped to have diameters that vary gradually from end to end, because the cores are long. Conversely, the shaft cores of shorter clubs are shaped to have diameters that vary steeply from end to end, because the cores are short. In FIG. 4 the thickness of the shaft core, which increases beneath grip 40*a* can be seen by phantom lines which follow the outer surface of the shaft core.

According to one embodiment of the present invention, the shaft core 40 of shorter clubs is shaped to have a larger diameter at the grip-end so as to increase the weight around the grip-end.

Figure 5:
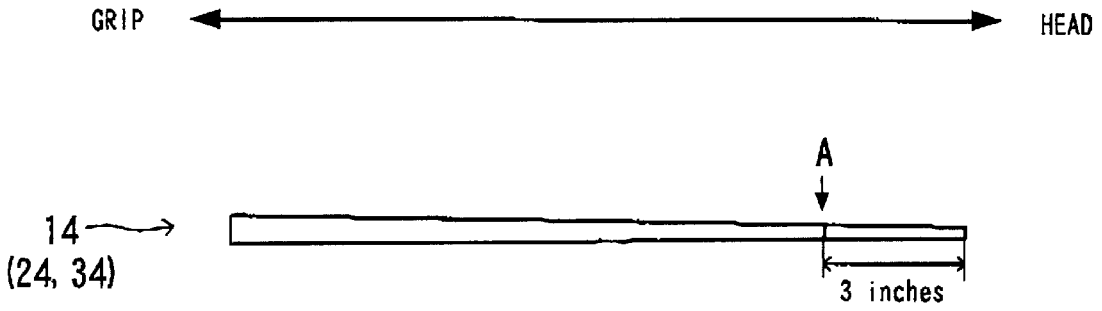
FIG. 5 is a diagram showing shafts of golf clubs in a golf club set according to another embodiment of the present invention.

FIG. 5 is a diagram showing shafts of golf clubs in a golf club set according to another embodiment of the present invention. As shown in FIG. 5, the diameter at a point A on a shaft 14 (24, 34) is controlled for each individual golf club in a golf club set. According to one example, for woods, the diameters at the head-end and grip-end of club shafts can be about 8.6 mm and about 15.0 mm, respectively. According to another example, for irons, the diameters at the head-end and grip-end can be about 9.4 mm and about 15.0 mm, respectively.

FIG. 6 is a table showing examples of diameters at a point A of shafts according one embodiment of the present invention. In FIGS. 5 and 6 point A is three inches away from the head-end of the shaft. Generally, club shafts for a given set of clubs have similar thicknesses measured from the outer diameter of the shaft cores and the outer diameter of the shafts. In this regard, the club shafts typically include a hollow core element and various layers such as carbon fibers which are wound around the core.

According to the present invention, for shorter clubs (more-lofted clubs), the diameter of the shafts at the point A is set to be larger. That is, shorter clubs are designed to have shafts with a thicker head-end, so that the shaft becomes mechanically stronger. As a result, such shorter clubs feel more stable to a player before and during a swing. Conversely, for longer clubs (less-lofted clubs) the diameter of the shafts at the point A is set to be smaller. Accordingly, longer clubs are designed to have shafts with thin head-ends. As a result, such longer clubs feel more sharp and less stable before and during a swing.

Embodiments of the invention exemplified in FIGS. 5 and 6 do not have to be used to the exclusion of the other embodiments of the present invention, because changes in the diameter of the shaft shells do not have to produce significant effects on the weight of the shafts. Accordingly, changes in the diameters can be accomplished so that they only affect the mechanical strength of the shafts. Since shorter clubs tend to have heavier heads, such clubs need stronger shafts, especially at the head-end.

According to the embodiments of the present invention which are set forth above, it is possible to design clubs having shafts that are ideally or optimally weight balanced according to the skill or experience of a particular player.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. A gold club set comprising a plurality of individual golf clubs having progressively increasing loft angles, each golf club of the set comprising:

a grip for grasping the club;

a head for hitting a ball; and a shaft connected between the grip and head, each shaft having a length, a grip-end, and a head-end, the shaft being divided length-wise into two portions that include a first portion inclusive of the grip-end, and a second portion inclusive of the head-end, the first and second portions having length ratios of 1 to 16, wherein:

each shaft has a weight balance at its grip-end thereof which increases from club to club as the corresponding loft angles of each of the respective clubs increase, the weight balance being controlled by regulating a weight ratio between the first and second portions of each shaft, the diameter of each shaft at a common distance from the head-end thereof increases from club to club as the loft angle thereof increases, and the loft angles increase from about 10° to 55° as the diameter at the common distance from the head-end increases from about 8.4 mm to 9.3 mm.

2. A gold club set comprising a plurality of individual golf clubs having progressively increasing loft angles, each golf club of the set comprising:

a grip for grasping the club;

a head for hitting a ball; and a shaft connected between the grip and head, each shaft having a length, a grip-end, and a head end, the shaft being divided length-wise into two portions that include a first portion inclusive of the grip-end, and a second portion inclusive of the head-end, the first and second portions having length ratios of 1 to 16, wherein:

each shaft has a weight balance at its grip-end thereof which increases from club to club as the corresponding loft angles of each of the respective clubs increase, the weight balance being controlled by regulating a weight ratio between the first and second portions of each shaft, the diameter of each shaft at a common distance of about 3 inches from the head-end thereof increases from club to club as the loft angle thereof increases, and the loft angles increase from about 10° to 55° as the diameter at the common distance from the head-end increases from about 8.4 mm to 9.3 mm.

* * * * *